United States Patent [19]

Massimei et al.

[11] 4,280,704

[45] Jul. 28, 1981

[54] METHOD FOR PLAYING A MILITARY WARFARE BOARD GAME

[76] Inventors: Gerald G. Massimei; Gerald G. Massimei, Jr., both of 515 Broadway, Bethpage, N.Y. 11714

[21] Appl. No.: 107,212

[22] Filed: Dec. 26, 1979

Related U.S. Application Data

[63] Continuation of Ser. No. 904,959, May 11, 1978, abandoned.

[51] Int. Cl.[3] ..... A63F 3/00

[52] U.S. Cl. ..... 273/258; 273/262; 273/265

[58] Field of Search ..... 273/238, 265, 262, 255, 273/275

[56] References Cited

U.S. PATENT DOCUMENTS

| | | | |
|---|---|---|---|
| 2,293,298 | 8/1942 | McDonald | 273/265 |
| 2,794,641 | 6/1957 | Baker | 273/265 |
| 3,191,937 | 6/1965 | Kropinski | 273/265 |
| 3,404,889 | 10/1968 | Warner | 273/238 |
| 3,779,553 | 12/1973 | Seeter | 273/275 |
| 4,004,810 | 1/1977 | Henrie | 273/249 |
| 4,057,253 | 11/1977 | Csoka | 273/265 |
| 4,078,805 | 3/1978 | Deaton | 273/275 |

FOREIGN PATENT DOCUMENTS

| | | | |
|---|---|---|---|
| 582709 | 1/1959 | Canada | 273/265 |

OTHER PUBLICATIONS

The Game of Hex; The Am. Mathematical Monthly; Dec., 1979; pp. 818–828.

*Primary Examiner*—Richard C. Pinkham
*Assistant Examiner*—Carl Moy
*Attorney, Agent, or Firm*—Allison C. Collard; Thomas M. Galgano

[57] ABSTRACT

A naval warfare board game apparatus is provided which consists of two sets of two grids or pegboards, each having a 10×10 grid pattern of peg holes, and one of which is a minefield grid and the other of which is a tracking grid. Each player hides his set from view of the other player and sets out 17 pegs, representing mines, on his minefield grid, without disclosing their position to his opponent. The first player then moves pegs representing his fleet of seventeen ships from a starting corner position on his tracking grid and attempts to cross the board to an opposite corner representing a "victory" position. During the voyage, if a player's fleet hits one of his opponents mines, his fleet is stopped and the other player then takes his turn and moves his fleet from the starting position. When, and if, the second player hits a mine the play reverts to the first player and he recharts his course from the position just prior to hitting the mine to continue on his voyage to the victory position. The game is won by either player reaching the victory position with at least one ship left in his fleet or by destroying all 17 ships of the opponent's fleet.

4 Claims, 2 Drawing Figures

METHOD FOR PLAYING A MILITARY WARFARE BOARD GAME

Figure 1:
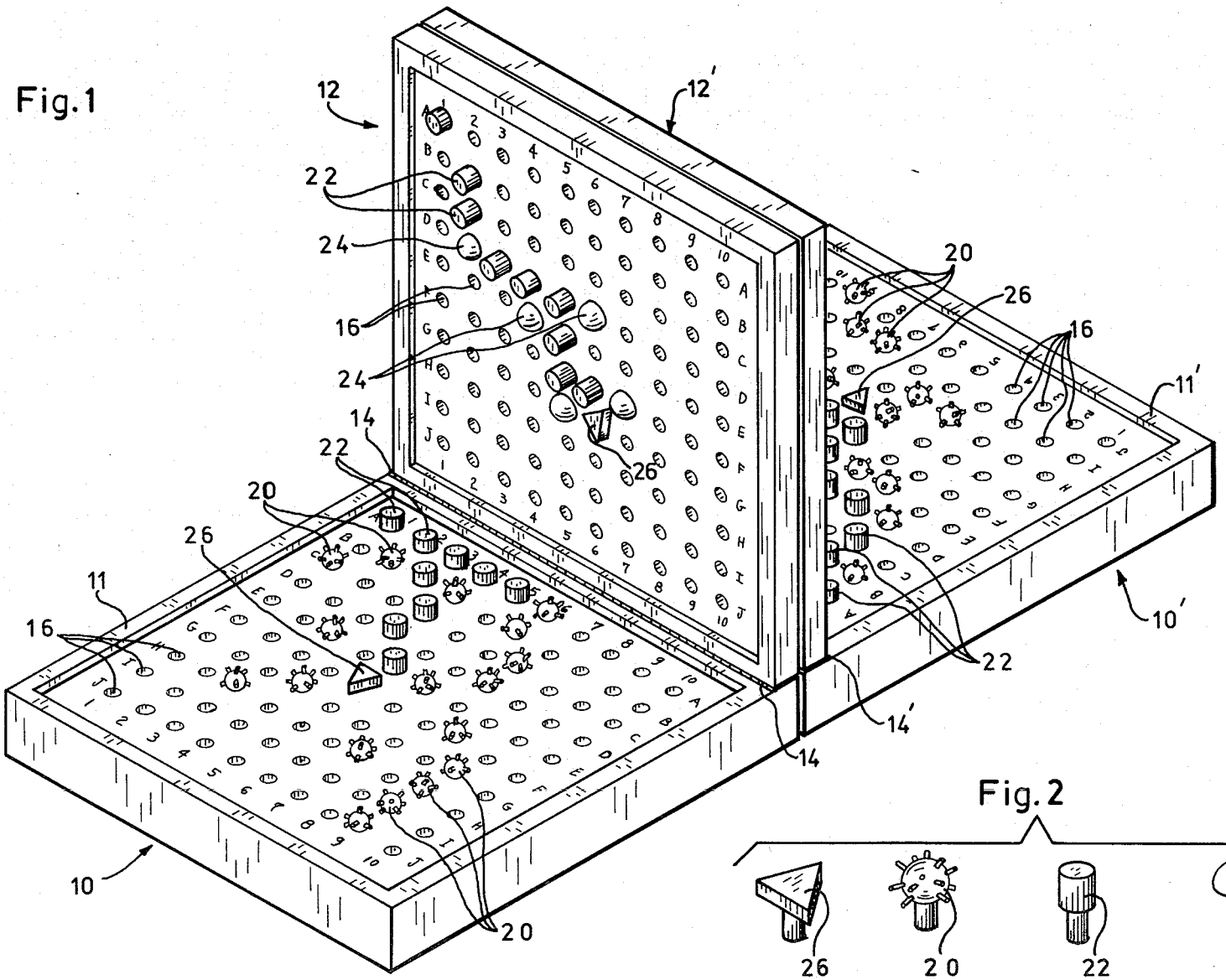

This is a continuation of application Ser. No. 904,959, filed May 11, 1978, now abandoned.

The present invention relates to a board game apparatus. More particularly, it relates to a board game apparatus which is intended to simulate naval warfare.

Board and parlor games which are used to simulate various aspects of real life experiences, particularly, in the field of military and naval warfare, are, of course, well known and widely used, both for entertainment as well as educational purposes. For example, there is a naval warfare game (See U.S. Pat. No. 3,381,963) wherein each player is provided with a rigid board which is divided generally into a ship area, containing a plurality of representations of ships, each of which is provided with one or more peg holes which is colored differently from the peg holes of the other ships, and a peg area comprising a 10×10 grid pattern of 100 peg holes in which 100 pegs are inserted.

Twenty-six of the pegs are distinctly colored at their lower ends and they correspond in number and color to the peg holes of the various ship representations. Each player inserts the colored pegs along with the remaining uncolored pegs in a random pattern in the peg holes of the peg area and then the players take turns removing one peg at a time from the other players peg area. If a player removes a peg having a colored lower portion, he inserts it in the corresponding colored peg hole in the ship area of the other player. When all of the peg holes of a player's ship area have been filled, his fleet is considered sunk and the other player wins.

Various attempts have been made to improve upon this type of naval warfare game but, so far as is known, in each case, they employ a "stagnant" non-movable arrangement of a player's fleet of ships. As a result, following initial placement or arrangement of one's fleet, the players have no further control over their fleet arrangement and the game's winner is typically decided more by chance than skill.

Accordingly, it is an object of the present invention to provide a novel board game method which simulates military and, in particular, naval warfare.

It is also an object of the present invention to provide such a novel board game method which is both entertaining as well as educational.

It is a further object of the present invention to provide such a novel board game which is relatively easy and simple to play and which may be economically fabricated.

It is a more particular object of the present invention to provide such a naval warfare board game method having the foregoing attributes and characteristics which permits the players to actively control the positioning and movement of their respective fleets during the course of play.

Certain of the foregoing and related objects are readily attained in accordance with the present invention by the provision of a military warfare board game apparatus which includes a pair of grids for each of the players, one of which is an offensive tracking grid and the other of which is a defensive network grid. Each of the grids has defined on a face thereof a multiplicity of playing spaces arranged in a plurality of columns and rows. Each of the playing spaces of the offensive tracking grid are positioned in a column and row corresponding to the column and row of a playing space on the defensive network grid and each of the grids is provided with a starting playing space and a finishing playing space which are positioned in a column and row corresponding to the column and row of the starting playing space and finishing playing space of the other grid.

The apparatus also includes a first token for each of the players which represents the player's offensive forces. The token is initially positionable on the starting space of the player's tracking grid and is at least randomly movable from one playing space on which it was previously positioned to an adjacent playing space on the player's tracking grid. A second token is also provided for each of the players which represents the opposing player's offensive forces. The second token is initially positionable on the starting space of the player's defensive network grid and is movable along the remaining spaces of the network grid in direct relationship to the movement of the first token of the opposing party on the opposing party's tracking grid, so that each player will be kept aware of the opposing player's movement of forces.

In addition, a plurality of third tokens is provided for each of said players which represent the players defensive forces. Each of these third tokens is randomly positionable on at least some of the playing spaces of the player's defensive network except for the starting and finishing spaces, and such that at least one continuous, uninterrupted path, defined by adjacent playing spaces of the network grid is maintained between the starting space and the finishing space thereof. The apparatus also includes a plurality of fourth tokens for each of the players, which represent at least a partial loss of the player's offensive forces and a defensive position held by the opposing player. When a player's first token lands on a playing space of the player's tracking grid which corresponds in row and column to a playing space on the opposing player's defensive network grid on which a third token of the opposing party is positioned, one of these fourth tokens is positioned on the playing space of the tracking grid in substitution of the first token, and the first token is repositioned on a playing space on the tracking grid on which it was previously positioned.

Preferably, a multiplicity of auxiliary first tokens is provided for each of the players, each of which is positionable on one of the playing spaces of the player's tracking grid on which the player's first token was previously positioned so as to keep track of the path of the player's offensive forces. Similarly, a multiplicity of auxiliary second tokens is provided for each of the players which is positionable on one of the playing spaces of the player's defensive network grid on which the player's second token was previously positioned so as to keep track of the path of the opposing player's offensive forces.

In a preferred emobodiment, the pair of grids for each of said players each consist of pegboard having a multiplicity of peg holes formed in a face thereof arranged in a plurality of columns and rows which define the playing spaces and the first, second, third, and fourth tokens each include a lower peg portion which is insertable in the peg holes for positioning the tokens on the playing spaces defined by the peg holes. Most advantageously, the pegboards each have 100 peg holes formed in the face thereof arranged in a 10×10 grid comprising ten horizontal rows and ten vertical columns of peg holes, which rows and columns are labeled so as to permit ready identification of the row and column location of each of the peg holes. Most desirably, the starting playing space of the grids is defined by a peg hole located in the first row and first column of the 10×10 grid of peg holes and the finishing playing space of the grids is defined by a peg hole located in the last row and last column of the 10×10 grid of peg holes.

In a particularly preferred embodiment of the invention, the first and second tokens represent a fleet of ships and each of the third tokens represent a mine which sinks one of the ships of the opposing player's fleet when the opposing player's first token is inserted in a peg hole of the opposing player's tracking grid which corresponds in row and column to the peg hole of the other player's defensive network grid in which one of the third tokens is inserted. It is desirable that the first token and the second token represent a fleet of seventeen ships and that each player is provided with seventeen third tokens, each of which represent a mine.

Most advantageously, the third tokens each have an upper portion which is configured in the shape of a mine, the first and second tokens each have an upper portion having a generally triangular shape, the auxiliary first and second tokens, each have a cylindrically-shaped upper portion, and the fourth tokens each have a semispherically-shaped upper portion. The first, second, third, and fourth tokens are preferably fabricated from plastic and are colored differently.

Most desirably, at least one of the grids of each pair includes mounting means for mounting the other grid of the pair thereon in a perpendicular relationship thereto. In a preferred method of mounting, one of the grids of each pair is hingeably secured to the other grid of the pair for movement between an open position, in which it is disposed perpendicular to the other grid of the pair, and a closed position, in which it is disposed parallel to, and lies flat against, the other grid.

Other objects and features of the present invention will become apparent from the following detailed description when taken in connection with the accompanying drawing which discloses one embodiment of the invention. It is to be understood that the drawing is designed for the purpose of illustration only, and is not intended as a definition of the limits and scope of the invention disclosed.

Figure 2:
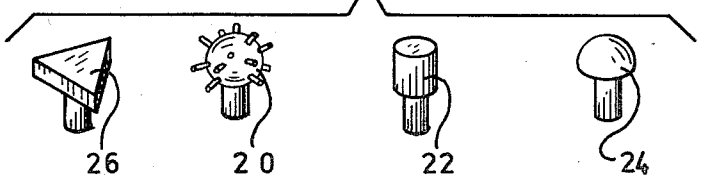

In the drawing, wherein similar reference numerals denote similar elements throughout the several views:

FIG. 1 is a perspective view of the novel game board apparatus embodying the present invention; and FIG. 2 is a perspective view of the playing pieces used in association with the game board illustrated in FIG. 1.

Turning now, in detail, to the appended drawings, therein illustrated is a novel game board apparatus embodying the present invention which, as shown in FIG. 1, includes two sets of two square-shaped grids or pegboards, one set being for each of the players. Each set includes a horizontally-disposed, "minefield" grid 10,10' and a vertically-disposed "tracking" grid 12, 12'. Each of the grids 10,10' and 12,12' have one hundred peg holes 16 formed in its front face arranged in a ten by ten grid pattern consisting of ten columns labeled "1 through 10" and ten rows labeled "A through J". Grid 12,12' of each set is secured along its lower bottom edge by means of a hinge 14,14' to the top face 11,11' of grid 10,10' of the same set adjacent to a longitudinal edge thereof, to permit grids 12,12' to be folded against grids 10,10' and permit easy storage thereof when not in use. Grids 10 and 10' are also provided with a top face 11,11' which, except for a border frame, is recessed to permit easy storage of the playing pieces when the game is not in use.

As shown in FIG. 1, when the game is played, grids 12,12' are pivoted to an upright position and are positioned back-to-back so that the opposing players cannot see the other player's grids. Although not illustrated, the abutting ends of grids 10,10' or 12,12' could be provided with coupling means to ensure that the two sets remain in abutting relationship during play.

The apparatus also includes a set of similar playing pieces for each of the players which includes (see FIG. 2) a multiplicity of pegs 20 (preferably seventeen) which represent mines and have a "mine-shaped" head portion, a multiplicity of pegs 22 (prefereably forty) which are used to plot the path of the ships of a player's fleet and which have a cylindrical head portion and a multiplicity of pegs 24 (preferably seventeen) which represent a mined area or a "sunk" ship and have a semispherical head portion. The apparatus also advantageously includes a pair of pegs 26 for each of the players which represent the player's fleet of ships (preferably seventeen) and which has a triangular-shaped head portion. Pegs 20, 22, 24, and 26 are preferably colored black, green, red, and white, respectively, for greater visual clarity. How these playing pieces are used in association with the grids will be described in greater detail hereinafter.

Turning now to the playing of the game, the object of the game is to move one's fleet consisting of seventeen ships from a starting position on the player's tracking grid board 12,12' (e.g., the peg hole defined by coordinates A-1) to a "victorious" end position (e.g., the peg hole defined by coordinates J-10) before the other player, while avoiding the mines set up by the other player on his minefield grid 10,10'. The game is won when one player reaches the J-10 victory position with at least one ship left in his fleet or when all of the ships of the opposing player's fleet have been destroyed.

In setting up the game, the two sets of grid boards 10, 12, and 10',12' are positioned in the manner shown in FIG. 1. Then, each player places his seventeen mines (pegs 20) in any desired pattern in the peg holes 16 of his minefield grid 10, 10'. The only exception is that at least one continuous, unobstructed path through the minefield must remain open for the opposing player's fleet of ships; if this is not done, the player automatically loses the game. As can be appreciated, the player's minefield is kept from view from the opposing player by means of the upstanding tracking grids 12 and 12'.

After each player sets up his minefield, it is then randomly determined, such as by a flip of a coin, who shall proceed first. The first player (who, for this example, controls grids 10 and 12) then moves his fleet, represented by fleet peg or token 26, from the starting peg hole A-1 of his tracking grid 12, to an adjacent peg hole represented by coordinates B-1, B-2, or A-2; the player's initial step in attempting to reach position J-10. As the first player makes his move, he calls out the coordinates of the move to the opposing player, places the fleet peg 26 in the peg hole representing the designated coordinates and places one of the pegs 22 in the peg hole representing coordinates A-1, in order to keep track of the path that the fleet takes.

The opposing player also charts the first player's fleet course, but does so on his minefield grid 10', with his set of pegs 22 and fleet peg 26. The first player continues to move (either vertically, horizontally, or diagonally) from one adjacent peg hole to the next, calling out his moves as he goes, until the opponent shouts "BOOM" to signify that the first player's fleet has run into one of his opponent's mines, sinking one of the ships in the fleet. Since each fleet consists of 17 ships, a player's fleet is destroyed and the game is lost by hitting the seventeen mines of the opposing player.

At this point, the first player has now lost or completed his turn by hitting a mine. The first player must now substitute one of the red pegs 24 representing a sunk ship or a mined area in the peg hole of his tracking grid 12 where he was hit and returns his fleet peg 26 to the previous peg hole in which it was positioned prior to hitting the mine. The red peg 24 thus represents a mined area on his tracking grid 12 where he has lost a ship and where he cannot pass through again.

It is then the second player's turn to move and he proceeds in a similar manner as the first player, calling out his moves and marking his course on his own tracking grid 12' while the first player keeps track of these moves on his minefield grid 10. The second player proceeds on his chosen courses to the victory position J-10 until he runs into one of the opposing player's mines, at which point, play reverts to the first player. Each time a player regains his turn, he starts out from the peg hole in which his fleet peg 26 was positioned just prior to being hit by a mine. From this position, he can proceed in any direction from one adjacent peg hole to the next, except for the peg hole which represents the position in which he was previously hit by the mine. The players are also permitted to back track over the previous course they have taken and leave it at any point. This is necessary to permit escape of a player's fleet which has been led down a corridor with mines on both sides and which, as a result, has nowhere to turn.

For example, as shown on grid 10, the opposing player initially led his fleet in a horizontal path, from position A-1 to position A-5 until it hit the mine at A-6. Then, the opposing player believing he was trapped by a corridor of mines located at positions B-3, B-4, and B-5 (although he was, in fact, free to move to B-4), decided to retrace his course and start again from position A-3, moving his fleet peg 26 to position B-3 and ultimately to position F-5.

The game continues in this fashion until one player reaches the J-10 position, which signifies capture of the enemy's homeland and victory to that player. As previously, mentioned, a player can also win if his opponent loses all seventeen ships of his fleet.

It should be noted that, in playing the game, it is important that each player keep track of the course of the opposing player's fleet. This is necessary to avoid errors, and arguments concerning the previous position of one's fleet.

It should also be appreciated that many variations and modifications made be made to the apparatus as will be apparent to those skilled in the art. For instance, although it is highly advantageous to employ a fleet peg 26 to represent one's fleet of ships, it would be possible to use only pegs 22 to chart the course of a player's fleet. In addition, means may be provided for keeping count of the number of ships a player has sunk of the opposing player's fleet. Alternatively, a player could keep track of the number of ships he has sunk by substituting one of pegs 24 for the mine peg 20 in his minefield grid which was responsible for sinking a ship of the opposing player's fleet.

It should also be pointed out that, although it is most desirable to use pegboards for the grids and to use pegs for the playing pieces, other constructions are possible such as employing magnetized sheets for the grids and magnetic tokens for the playing pieces. In addition, although the grids and playing pieces are preferably fabricated from plastic, other suitable materials, such as wood or metal, may be employed. The configuration of the boards, pegs, number of rows and columns of peg holes, and the number of mines and ships may also be varied to suit individual preferences, although the illustrated and described embodiment is believed to afford an optimum arrangement for playing the game.

Thus, while only one embodiment of the present invention has been shown and described, it will be obvious to those persons of ordinary skill in the art that many changes and modifications may be made thereunto without departing from the spirit and scope of the invention.

What is claimed is:

1. A method of playing a naval warfare board game for at least two players of the type which includes a pair of pegboard grids for each of the players including an offensive tracking grid and a defensive network grid, each of which has defined on a face thereof a multiplicity of peg holes defining playing spaces arranged in a plurality of columns and rows, with each of said playing spaces of said offensive tracking grid being positioned in a column and row corresponding to the column and row of a playing space on said defensive network grid, and with each of said grids having a peg hole defining a starting playing space and a finishing playing space which are positioned in a column and row corresponding to the column and row of the starting playing space and finishing playing space of the other grid, one primary first token for each of the players, representing the player's fleet of ships, a multiplicity of auxiliary first tokens for each of the players, one primary second token for each of the players, representing the opposing player's fleet of ships, a multiplicity of auxiliary second tokens for each of the players, a plurality of third tokens for each of said players representing a mine for sinking one of the ships of the opposing player's fleet, and a plurality of fourth tokens for each of the players, representing at least a partial loss of the player's fleet and a mined defensive position held by the opposing player, the steps comprising:

each of said players initially inserting said plurality of third tokens representing their defensive forces in the peg holes on their defensive network grid in any desired arrangement except those peg holes representing said starting and finishing spaces and such that at least one continuous and uninterrupted path defined by adjacent playing spaces of the defensive network grid is maintained between said starting and finishing spaces thereof;

each of said players inserting their primary first and second tokens in the peg holes representing said starting spaces of their offensive and defensive network grids, respectively;

each of said players, in successive alternating turns, moving one's primary first token from said starting space peg hole to an adjacent playing space peg hole, and for each successive turn, from one playing space peg hole in which it was previously positioned to an adjacent playing space peg hole on the player's offensive tracking grid in an attempt to move said primary first token along a desired path to said peg hole representing said finishing space;

each of said players moving one's primary second token from one playing space peg hole in which it was previously positioned to an adjacent playing space peg hole on the defensive network grid in direct relationship to the movement of the primary first token on the opposing party's tracking grid;

each of said players repositioning one's primary first token on said tracking grid in a playing space peg hole it was previously positioned, when said player's primary first token lands on a playing space of said tracking grid which corresponds in row and column to a playing space on the opposing player's defensive network grid on which a third token of the opposing player is positioned;

each of said players inserting one of their fourth tokens in said playing space peg hole of said tracking grid which corresponds in row and column to said playing space peg hole on the opposing player's defensive network grid in which said third token of the opposing player is positioned in substitution of said first token which is repositioned in said playing space peg hole it was previously positioned;

each of said players inserting one of said auxiliary first tokens in a playing space peg hole of said offensive tracking grid in which said primary first token was previously positioned so as to permit charting of the path of the player's offensive forces; and each of said players placing one of said auxiliary second tokens in one of the playing space peg holes of the player's defensive network grid in which the player's primary second token was previously positioned so as to permit charting of the path of the opposing player's offensive forces.

2. A method of playing a military warfare board game for at least two players of the type which includes a pair of grids for each of the players including an offensive tracking grid and a defensive network grid, each of which has defined on a face thereof a multiplicity of playing spaces arranged in a plurality of columns and rows, with each of said playing spaces of said offensive tracking grid being positioned in a column and row corresponding to the column and row of a playing space on said defensive network grid, and with each of said grids having a starting playing space and a finishing playing space which are positioned in a column and row corresponding to the column and row of the starting playing space and finishing playing space of the other grid, at least one first token for each of the players representing the player's offensive forces, a plurality of auxiliary first tokens for each of the players, at least one second token for each of the players representing the opposing player's offensive forces, a plurality of third tokens for each of said players representing the player's defensive forces, a plurality of fourth tokens for each of the players representing at least a partial loss of the player's offensive forces, and a defensive position held by the opposing player, the steps comprising:

each of said players initially positioning said plurality of third tokens representing their defensive forces on their defensive network grid in any desired arrangement except on said starting and finishing spaces;

each of said players positioning their first and second tokens on the starting spaces of their offensive and defensive network grids, respectively;

each of said players, in successive alternating turns, moving one's first token from said starting space to an adjacent playing space and, for each successive turn, from one playing space on which it was previously positioned to an adjacent playing space on the player's offensive tracking grid in an attempt to move said first token along a desired path to said finishing space;

each of said players placing one of said auxiliary first tokens on a playing space of said offensive tracking grid on which said first token was previously positioned so as to permit charting of the path of the player's offensive forces;

each of said players moving one's second token from one playing space on which it was previously positioned to an adjacent playing space on the defensive network grid in direct relationship to the movement of the first token on the opposing party's tracking grid;

each of said players repositioning one's first token on said tracking grid on a playing space it was previously positioned when said player's first token lands on a playing space of said tracking grid which corresponds in row and column to a playing space on the opposing party's defensive network grid on which a third token of the opposing player is positioned; and each of said players placing one of their fourth tokens on said playing space of said tracking grid which corresponds in row and column to said playing space on the opposing player's defensive network grid on which said third token of the opposing player is positioned in substitution of said first token which is repositioned on said playing space it was previously positioned.

3. A method of playing a military warfare board game for at least two players of the type which includes a pair of grids for each of the players including an offensive tracking grid and a defensive network grid, each of which has defined on a face thereof a multiplicity of playing spaces arranged in a plurality of columns and rows, with each of said playing spaces of said offensive tracking grid being positioned in a column and row corresponding to the column and row of a playing space on said defensive network grid, and with each of said grids having a starting playing space and a finishing playing space which are positioned in a column and row corresponding to the column and row of the starting playing space and finishing playing space of the other grid, at least one first token for each of the players representing the player's offensive forces, at least one second token for each of the players representing the opposing player's offensive forces, a plurality of auxiliary second tokens for each of the players, a plurality of third tokens for each of said players representing the player's defensive forces, a plurality of fourth tokens for each of the players representing at least a partial loss of the player's offensive forces, and a defensive position held by the opposing player, the steps comprising:

each of said players initially positioning said plurality of third tokens representing their defensive forces on their defensive network grid in any desired arrangement except on said starting and finishing spaces;

each of said players positioning their first and second tokens on the starting spaces of their offensive and defensive network grids, respectively;

each of said players, in successive alternating turns, moving one's first token from said starting space to an adjacent playing space and, for each successive turn, from one playing space on which it was previously positioned to an adjacent playing space on the player's offensive tracking grid in an attempt to move said first token along a desired path to said finishing space;

each of said players moving one's second token from one playing space on which it was previously positioned to an adjacent playing space on the defensive network grid in direct relationship to the movement of the first token on the opposing player's tracking grid;

each of said players placing one of said auxiliary second tokens on one of the playing spaces of the player's defensive network grid on which the player's second token was previously positioned so as to permit charting of the path of the opposing player's offensive forces;

each of said players repositioning one's first token on said tracking grid on a playing space it was previously positioned when said player's first token lands on a playing space of said tracking grid which corresponds in row and column to a playing space on the opposing player's defensive network grid on which a third token of the opposing player is positioned; and each of said players placing one of their fourth tokens on said playing space of said tracking grid which corresponds in row and column to said playing space on the opposing player's defensive network grid on which said third token of the opposing player is positioned in substitution of said first token which is repositioned on said playing space it was previously positioned.

4. The method according to claim 2 or 3, wherein said plurality of third tokens are positioned on said defensive network grid of each of said players such that at least one continuous and uninterrupted path, defined by adjacent playing spaces of the defensive network grid is maintained between said starting and finishing spaces thereof.

* * * * *